United States Patent [19]

Chielens et al.

[11] 4,270,704

[45] Jun. 2, 1981

[54] CRUSHER

[75] Inventors: Alain Chielens, Marcq-en-Baroeul; Bernard Boussekey, Lille, both of France

[73] Assignee: Fives-Cail Babcock, Paris, France

[21] Appl. No.: 968,725

[22] Filed: Dec. 12, 1978

[30] Foreign Application Priority Data

Dec. 13, 1977 [FR] France ..... 77 37446
Apr. 28, 1978 [FR] France ..... 78 12614

[51] Int. Cl.[3] ..... B02C 15/04

[52] U.S. Cl. ..... 241/122; 241/117; 241/107

[58] Field of Search ..... 241/107, 117–122

[56] References Cited

U.S. PATENT DOCUMENTS 2,475,814 7/1949 Bruchsaler ..... 241/121 X
2,875,959 3/1959 Calkins ..... 241/119 X
4,155,511 5/1979 Kartman et al. ..... 241/117

*Primary Examiner*—Richard B. Lazarus
*Attorney, Agent, or Firm*—Kurt Kelman

[57] ABSTRACT

A ball or grindstone crusher comprises a frame including a support and a table mounted on the frame support for rotation about a vertical axis, and table having arranged thereon an annular track and the frame support extending in a plane below the annular track. Balls or grindstones are rollingly supported on the track and are pressed thereagainst. A first series of bearings supports the table on the frame support and a second series of bearings is disposed at the same level as the first series of bearings. The table has a skirt defining a cylindrical surface coaxial with the annular track and the second series of bearings bears against the cylindrical surface and thereby maintains the table in a stable lateral position with respect to the axis of rotation.

10 Claims, 2 Drawing Figures

Figure 1:
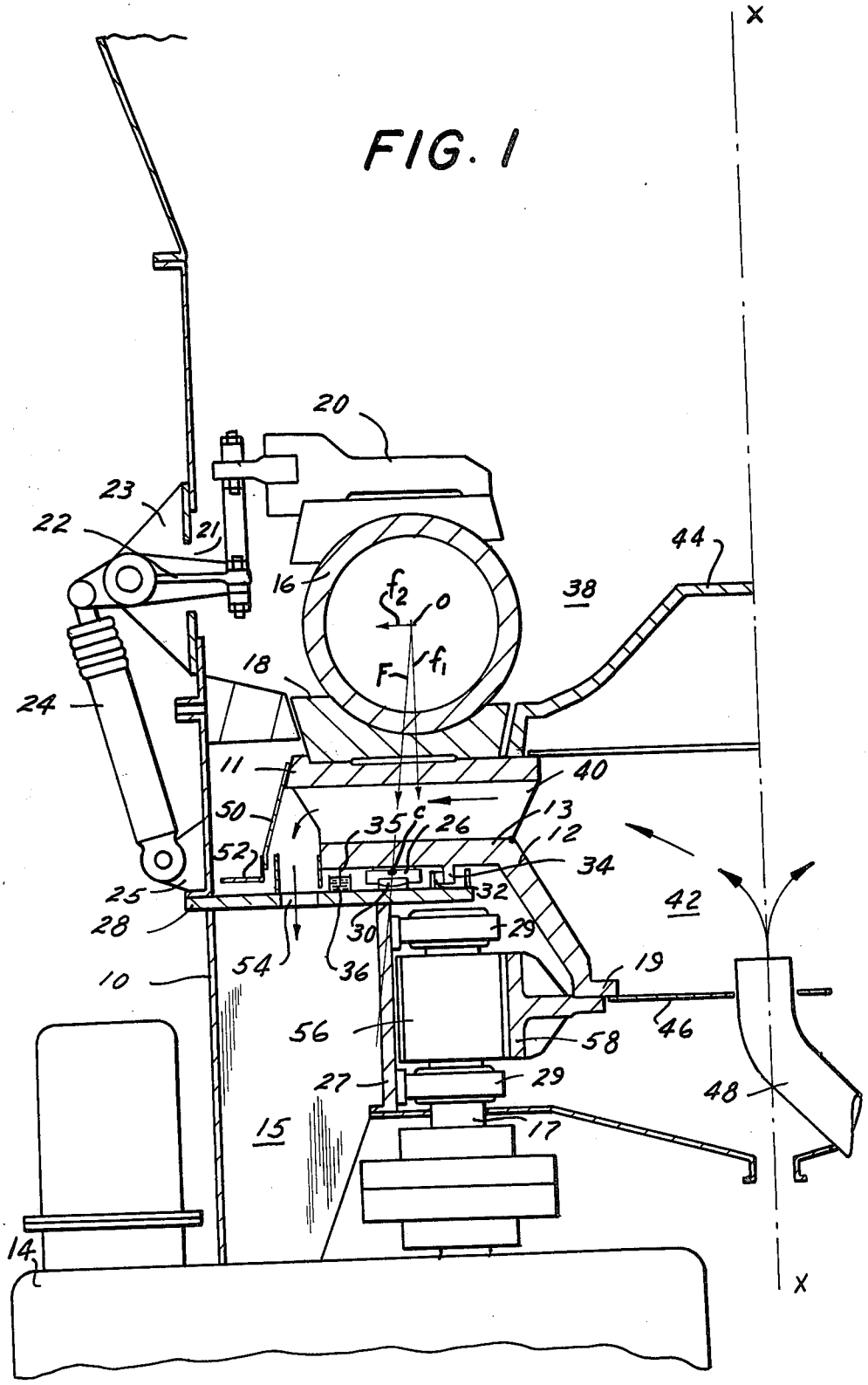

X
20
23
22
21
16
$f_2$
O
F
$f_1$
18
24
11
40
50
35
c
26
13
12
52
34
25
32
42
28
30
29
54
36
19
10
56
58
46
27
29
48
15
17
14
X

CRUSHER

The present invention relates to improvements in a crusher useful, for example, for milling ores, cement clinker and the like, and comprising a frame including a support affixed to the frame, a table mounted on the frame support for rotation about a vertical axis and having arranged thereon an annular track, the frame support extending in a plane below the annular track, crushing elements rollingly supported on the track, and means mounted on the frame for pressing the crushing elements against the track with a sufficient force to crush products delivered to the track.

In known crushers of this type, the table is rigidly affixed to the output shaft of a control motor so that all forces to which the table is subjected are absorbed by the crankcase of the motor. This construction requires a specially designed drive motor with a crankcase of sufficient strength to support the crushing forces. It also requires a table capable of resisting the stresses due to the fact that the crushing forces are applied to its periphery and are absorbed in its center. Furthermore, the support frame of the crusher and the drive are mounted individually on their foundations, which makes centering of the table in the support frame more difficult and makes it necessary to provide fixtures on the frame for absorbing the reaction forces from the devices used to press the crushing elements against the annular track.

In U.S. Pat. No. 4,155,511, it has also been proposed to support the table on bearings mounted on a support independent of the motor crankcase but still retaining a central shaft mounted on a fixed support to assure centering of the table. Since this support was positioned exactly below the crushing track, the lateral forces to which the table was subjected created stresses in the shaft and in the table. In these structures, the bearing support and the central support are still independent of the frame of the crusher.

It is the primary object of this invention to overcome these disadvantages and to provide a structure in which the forces to which the crushing table is subjected are absorbed as closely as possible to the crushing track so as to reduce the stresses on the table and, as a result, to permit its weight and cost to be reduced, these forces being transmitted to the frame supporting the crusher without passing through the foundations.

The above and other objects are accomplished according to the invention in a crusher of the first-described type with a first series of bearings supporting the table on the frame support and a second series of bearings disposed substantially at the same level as the first series of bearings. The table has a skirt defining a cylindrical surface coaxial with the annular track and the second series of bearings bears against the cylindrical surface and thereby maintains the table in a stable lateral position with respect to the axis of rotation.

Figure 2:
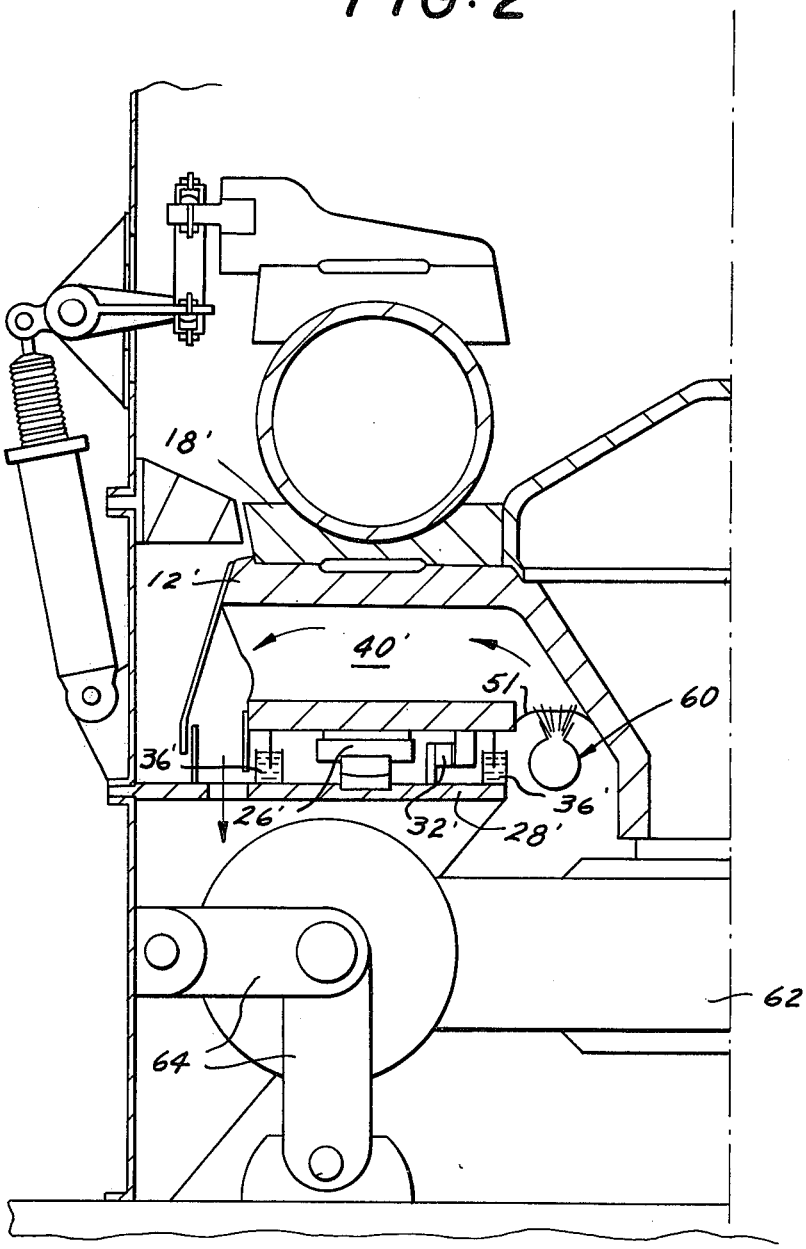

The objects, advantages and features of the present invention will become more apparent from the following detailed description of two now preferred embodiments thereof, taken in conjunction with the accompanying drawing wherein FIG. 1 is a vertical section showing one half of a ball mill according to one embodiment of this invention and FIG. 2 is a like view of another embodiment thereof.

Referring first to FIG. 1, there is shown a crusher comprising frame 10 constituting a casing and including support 28 affixed to the frame and forming an annular platform extending radially inwardly from frame 10. Annular table 12 is mounted on frame support 28 for rotation about vertical axis X—X and the table has arranged thereon annular track 18, the frame support extending in a plane below the annular track. The table has upper face 11 wherein the annular track is arranged and lower face 13, radially extending ducts 40 being defined between the upper and lower faces of rotary table 12. Crushing elements illustrated as a series of balls 16 are rollingly supported on track 18 and means is mounted on frame 10 for pressing balls 16 against the track. The illustrated pressing means includes shoe 20 mounted on levers 22 extending through openings 21 in frame 10 and pivoted to brackets 23 mounted on the frame, the levers being operated by jacks 24 having one end linked to the levers while their other end is linked to brackets 25 mounted on the frame. Operation of the jacks will pull shoes 20 down to engage balls 16 and press them against track 18.

A first series of annularly arranged bearings 26 supports rotary table 12 on frame support 28. The bearings comprise universal joints 30, shown as ball-and-socket joints, permitting the bearings to orient themselves freely in all directions. Frame support 28 is constituted by an annular platform supported by brackets 15 welded to frame 10.

In the preferred illustrated embodiment in which the crushing elements are balls turning about the axis of rotation in a concentric circular path, the centers C of bearing 26 are more remote from axis X—X than the centers O of the balls, the first series of bearings being displaced radially outwardly with respect to the circular path. The displacement is such that the resultants F of the pressure forces $f_1$, which extend vertically, and the centrifugal forces $f_2$ caused by the rotation of the balls about the axis of rotation of the crusher table pass approximately through the median line of the gliding surface of bearings 26, which is the line traced on this surface equidistantly from the interior and exterior edges of the bearings.

In a generally known manner, an oil basin placed at an end of each bearing and fed by a low-pressure pump forms, during normal operation, an oil wedge assuring hydrodynamic lubrication of the bearings and permits the table to glide on the bearings. Delivery of oil under high pressure to the center of each bearing permits a hydrostatic lubrication at the start of the operation or during a breakdown of the hydrodynamic lubrication system. If desired, only a hydrostatic lubricating system may be used.

A second series of bearings 32 is disposed substantially at the same level as the first series of bearing 26 to assure proper centering of rotary table 12. The table has skirt 34 depending therefrom and defining a cylindrical surface coaxial with annular track 18 and the second series of bearings 32 bears against this cylindrical surface and thereby maintains the table in a stable lateral position with respect to axis of rotation X—X. These bearings, too, comprise universal joints between the cylindrical skirt surface and the bearings to permit their free movement in all directions and they are lubricated in the same manner as bearings 26.

Annular hydraulic joint 36 is disposed between frame support 28 and rotary table 12, the joint surrounding the two series of bearings 26 and 32 to prevent dust from crushing chamber 38 from reaching the bearings. The hydraulic joint is constituted by a circular trough affixed to frame support 28 and concentrically surrounding the two series of bearings, the trough being filled with liquid, which may be the lubricating oil for the bearings, annular wall 35 extending from table 12 downwardly to be immersed in the liquid to form a seal. Suitable means (not shown) is provided for circulating and filtering the liquid to prevent accumulation of dust in the trough.

Obviously, other types of seals may be provided to protect the bearings from being fouled by the dust coming from the crusher, such as baffle or friction joints.

If hot air is blown through the crusher to dry the crushed product, the rotary table must be cooled to prevent the gliding surfaces of the bearings from reaching excessively high temperatures. For this purpose, ducts 40 respectively opening at the periphery of rotary table 12 and into inner chamber 42 of the annular table are defined in a table portion under which the two series of bearings 26 and 32 extend concentrically, and means is provided for centrifugally circulating cooling air through the ducts. The ducts may extend radially or may be shaped like those between turbine vanes. The inner chamber 42 is defined in the center of annular table 12 between two covers 44 and 46 which are mounted on the table. The means for circulating cooling air through ducts 40 comprises tubing 48 having an outer end attached to a blower (not shown) delivering cooling air into the tubing and inner chamber, this air being centrifugally sucked through ducts 40 upon rotation of table 12 to pass through the duct openings at the periphery of the table and thus to cool the portion of the table which holds the bearings. Annular baffle means comprised of baffle 50 affixed to upper face 11 of the table and baffle 52 affixed to frame support 28 and cooperating with baffle 50 surround the periphery of the table and are arranged to deflect the cooling air coming from ducts 40 downwardly. The deflected cooling air forms a curtain concentrically surrounding the bearings and preventing dust from reaching the bearings. Orifices 54 are defined in frame support 28 to permit the cooling air to pass out of the crusher. In this manner, the cooling air further protects the bearings, in addition to the hydraulic joint.

The means for rotating table 12 comprises a suitable drive motor 14 whose output shaft is connected to transmission gear 56 meshing with ring gear 58 affixed to flange 19 of table 12. Gear 56 is mounted on support frame 28 by means of bracket 27 carrying fixed bearings 29 for the gear.

In the embodiment of FIG. 2, the support and centering of rotary table 12' are substantially the same as in the embodiment of FIG. 1 and will, therefore, not be further described, except where any structure differs from that of the first-described embodiment. In this embodiment, the two series of bearings 26' and 32' are enclosed in a sealed chamber defined by frame support 28' and two hydraulic joints 36', 36' arranged concentrically, the sealed bearing chamber being disposed below annular crushing track 18'. Ducts 40' are defined between the upper and lower faces of the table and the lower face defines cooling air inlet 51 inwardly displaced from the sealed bearing chamber. The cooling air circulating means comprises annular air distributing means 60, such as a nozzle, facing inlet 51 and arranged to inject or blow the cooling air thereinto.

The means for rotating table 12' comprises floating drive unit 62 comprising a motor driving a pinion meshing with a toothed wheel fast with a stub shaft fitted in the table and a housing rotatably supported on the stub shaft, the weight of the motor and the torque being absorbed by connecting rods 64 pivoted to the frame of the crusher. In all other respects, the crusher is constructed and functions in the same manner as that of FIG. 1.

While illustrated in connection with ball mills, the invention is equally applicable to crushers with grindstones or rollers, as crushing elements, and various modifications of equivalent structures will readily occur to those skilled in the art without departing from the spirit and scope of this invention as defined in the appended claims.

What is claimed is:

1. A crusher comprising (a) a casing frame having a vertical axis and including
  (1) a support affixed to the frame and extending radially inwardly from the frame, (b) a table mounted on the support for rotation about the vertical axis, the table having arranged thereon
  (1) an annular track, the frame support extending in a plane below the annular track, (c) crushing elements rollingly supported on the track, (d) means mounted on the casing frame for pressing the crushing elements against the track, (e) a first series of bearings supporting the table on the frame support and (f) a second series of bearings disposed substantially at the same level as the first series of bearings
  (1) the table having a skirt defining a cylindrical surface coaxial with the annular track and the second series of bearings bearing against the cylindrical surface and thereby maintaining the table in a stable lateral position with respect to the axis of rotation.

2. The crusher of claim 1, wherein the bearings comprise universal joints permitting the bearings to orient themselves freely in all directions.

3. The crusher of claim 1, wherein the crushing elements have a center turning about the axis of rotation in a concentric circular path and the first series of bearings has centers displaced radially outwardly with respect to the circular path, the bearings of the first series having an upper surface in gliding contact with a lower surface of the table in a plane and the centers of the bearings defining a circle in said plane, the radial displacement being such that the resultants of the pressure and centrifugal forces to which the crushing elements are subjected pass approximately through said circle.

4. The crusher of claim 1, further comprising means for rotating the table, the rotating means comprising gear means mounted on the frame and a ring gear on the table and meshing with the gear means.

5. A crusher comprising (a) a casing frame having a vertical axis and including
  (1) a support affixed to the frame and extending radially inwardly from the frame, (b) a table mounted on the support for rotation about the vertical axis, the table having arranged thereon
  (1) an annular track, the frame support extending in a plane below the annular track, (c) crushing elements rollingly supported on the track, (d) means mounted on the casing frame for pressing the crushing elements against the track, (e) a first series of bearings supporting the table on the frame support, (f) a second series of bearings disposed substantially at the same level as the first series of bearings, (1) the table having a skirt defining a cylindrical surface coaxial with the annular track and the second series of bearings bearing against the cylindrical surface and thereby maintaining the table in a stable lateral position with respect to the axis of rotation, and (2) the two series of bearings being disposed in two zones extending concentrically under a portion of the table supporting the annular track, (3) this table portion defining ducts opening at the periphery of the table, and (g) means centrifugally circulating cooling air through the ducts.

6. The crusher of claim 5, further comprising annular baffle means around the periphery of the table and arranged to deflect the cooling air coming from the ducts downwardly, the deflected cooling air forming a curtain preventing dust from reaching the bearings.

7. The crusher of claim 5, wherein the table defines a center chamber, the ducts opening into the center chamber, and the circulating means comprises means for feeding the cooling air to the center chamber whence it is passed centrifugally through the ducts.

8. The crusher of claim 5, wherein the table has an upper face whereon the annular track is arranged and a lower face, the ducts being defined between the upper and lower faces of the table, the lower face defining a cooling air inlet, and the circulating means comprises an annular air distributing means facing the inlet and arranged to inject the cooling air thereinto.

9. The crusher of claim 5, further comprising an annular hydraulic joint between the frame support and the table, the joint surrounding the two series of bearings.

10. The crusher of claim 9, wherein the two series of bearings are enclosed in a sealed chamber defined by the frame support and two of said annular hydraulic joints arranged concentrically.

* * * * *